US006652335B1

(12) United States Patent
Peschmann et al.

(10) Patent No.: US 6,652,335 B1
(45) Date of Patent: Nov. 25, 2003

(54) POSITIONALLY ADJUSTABLE MOUNTING DEVICE

(75) Inventors: Joseph J. Peschmann, Plover, WI (US); Kevin J. Brown, Mosinee, WI (US)

(73) Assignee: Cequent Trailer Products, Inc., Mosinee, WI (US)

( * ) Notice: Subject to any disclaimer, the term of this patent is extended or adjusted under 35 U.S.C. 154(b) by 0 days.

(21) Appl. No.: 10/166,304

(22) Filed: Jun. 10, 2002

(51) Int. Cl.[7] ..... B63H 20/08
(52) U.S. Cl. ..... 440/59; 248/642
(58) Field of Search ..... 440/53, 59; 248/641, 248/642; 254/101, 102, 103, 98, 122

(56) References Cited

U.S. PATENT DOCUMENTS

| | | | | | |
|---|---|---|---|---|---|
| 2,546,361 | A | * | 3/1951 | Floyd | 254/122 |
| 2,643,837 | A | | 6/1953 | Rivers | |
| 2,747,819 | A | | 5/1956 | Aldrich et al. | |
| 2,757,888 | A | | 8/1956 | Branstrator | |
| 2,928,630 | A | | 3/1960 | Wisman | |
| 2,928,631 | A | | 3/1960 | Hartman | |
| 3,242,899 | A | | 3/1966 | Hanson | |
| 3,752,431 | A | * | 8/1973 | McBride | 248/291.1 |
| 3,765,676 | A | * | 10/1973 | Bearson et al. | 248/281.11 |
| 3,782,713 | A | * | 1/1974 | Yount | 248/396 |
| 4,013,249 | A | | 3/1977 | Meyer et al. | |
| 4,025,053 | A | * | 5/1977 | Stickle, Jr. | 254/122 |
| 4,076,193 | A | | 2/1978 | Weaver | |
| 4,272,058 | A | * | 6/1981 | Van Santen | 254/98 |
| 4,379,540 | A | * | 4/1983 | French | 248/406.2 |
| 4,872,859 | A | | 10/1989 | Griffiths et al. | |
| 5,522,578 | A | | 6/1996 | Mayfield | |
| 5,664,762 | A | * | 9/1997 | Rothbauer | 254/103 |
| 5,791,954 | A | * | 8/1998 | Johnson, Jr. | 440/58 |
| 5,964,627 | A | | 10/1999 | Detwiler | |
| 6,305,996 | B1 | | 10/2001 | Detwiler | |

* cited by examiner

*Primary Examiner*—S. Joseph Morano
*Assistant Examiner*—Lars Olson
(74) *Attorney, Agent, or Firm*—Robert H. Earp, III; McDonald Hopkins Co., LPA

(57) ABSTRACT

A mounting device for vertically positionally adjusting an outboard motor relative to a boat transom, the mounting device comprising at least one bracket connected to a transom, at least one support member pivotally connected to the bracket at one end and connected to an outboard motor at the other end wherein the motor is vertically positionally adjustable relative to the transom upon pivotal movement of the support member. A jack member controls the pivotal movement of the support member and comprises telescoping inner and outer tubes wherein the inner tube is connected to the transom and the outer tube is connected to the support member wherein telescopic movement of the outer tube relative to the inner tube pivots the support member to vertically positionally adjust the motor relative to the boat transom.

21 Claims, 3 Drawing Sheets

POSITIONALLY ADJUSTABLE MOUNTING DEVICE

FIELD OF INVENTION

The present invention relates generally to the raising or lowering of a supported object, and more particularly, to a mounting device for vertically positionally adjusting an outboard motor relative to a boat transom.

BACKGROUND OF THE INVENTION

Devices such as outboard motors are supported from supports such as boat transoms by a mounting assembly. Outboard motors typically utilize a transom bracket for mounting the motor directly on the boat transom. However, it is known that spacing the motor aft of the transom improves boat handling characteristics at high speeds. Further, the motor must be lowered and possibly slightly adjusted in height to enable to the motor to run most efficiently during use. Permitting the raising or lowering of the motor with respect to the transom during in-water operation can greatly effect initial boat acceleration and motor performance. Further, it is desirable to raise the motor during boat transport, boat launch, or removing the boat from the water.

Mounting assemblies that space the motor aft of the transom and permit the motor position to be adjusted vertically with respect to the transom are known in the art. One such mounting assembly is shown in U.S. Pat. No. 4,872,859 issued on Oct. 10, 1989, to John M. Griffiths et al. However, the assembly shown therein permits the vertical adjustment of the outboard motor in only two positions, a raised position or a lowered position. The '859 device provides no ability to adjust the height of the motor over a range of positions between the highest or lowest positions during use. Further, there is no ability to adjust the height or lift ratios once the assembly is mounted to the transom.

Several prior art devices permit the motor position to be adjusted vertically with respect to the transom over a range of positions between the highest or lowest positions. Typically, however, these devices are complex mechanisms that are difficult to install or use. Such devises are see in U.S. Pat. Nos. 2,747,819; 2,928,631; and 3,242,899.

Typical of such devices is the mounting assembly disclosed in U.S. Pat. No. 5,964,627 issued on Oct. 12, 1999, to Timothy P. Detwiller. The '627 patent discloses a manually adjusted outboard motor mount which permits motor movement in a straight, substantially vertical path relative to the transom. The motor bracket of the'627 patent is adjusted vertically by a shaft threaded into the transom bracket that is rotated by a crank. While permitting the vertical adjustment of the motor with respect to the transom, the device of the'627 patent offers no adjustment in the height or lift ratios once mounted to the transom. Further, the design of the mounting assembly of the '627 patent creates a small confined space in which to crank the assembly to raise or lower the motor.

Therefore, there is a need in the art to provide a mounting assembly which easily raises and lowers an outboard motor along a continuous range of positions and which is inexpensive and simple to manufacture. Further, it is desirable in the art to provide a motor mount that can be easily adjusted to accommodate large as well as small outboard motors and be simple to operate. The device of the present invention meets the needs of the art and overcomes the disadvantages of the prior art devices.

BRIEF SUMMARY OF THE INVENTION

An object of the present invention is to provide a mounting device which is inexpensive and simple to manufacture.

Another objection of the present invention is to provide a mounting device that can be easily adjusted to accommodate large as well as small supported objects.

A further objection of the present invention is to provide a mounting device which easily raises and lowers a supported object along a continuous range of positions.

Yet another object of the present invention is to provide a mounting device which is easily adjustable to provide a plurality of lifting ratios and lifting heights.

The forgoing and other objects of this invention are achieved by providing a mounting device comprising a deformable frame assembly connected to a support wherein the supported device is positionally adjustable upon selective deformation of the frame assembly. Such deformation of the frame assembly is accomplished through providing a jack member comprising telescoping inner and outer tubes wherein the inner tube is connected to the support and the outer tube is connected to the frame assembly wherein telescopic movement of the outer tube relative to the inner tube deforms the frame assembly to positionally adjust the supported device.

The present invention will be more fully described in the following written description with reference to the accompanying drawings.

DETAILED DESCRIPTION OF THE INVENTION

The mounting device of the present invention positionally adjusts a supported device relative to a support. Such a mounting device generally utilizes a deformable frame assembly connected at one end to a support and at the other end to a supported device. Upon selective deformation of the frame assembly, the supported device is positionally adjustable relative to the support. A jack member controls the selective deformation of the frame assembly through telescoping inner and outer tubes. The inner tube is connected to the support and the outer tube is connected to the frame assembly wherein telescopic movement of the outer tube relative to the inner tube positionally adjusts the supported device.

The preferred embodiment of the mounting device, disclosed herein by way of example, positionally adjusts an outboard motor relative to a boat transom. However, it should be clear that this invention is not limited to the preferred embodiment and could be used to positionally adjust any supported device related to a support.

Figure 3:
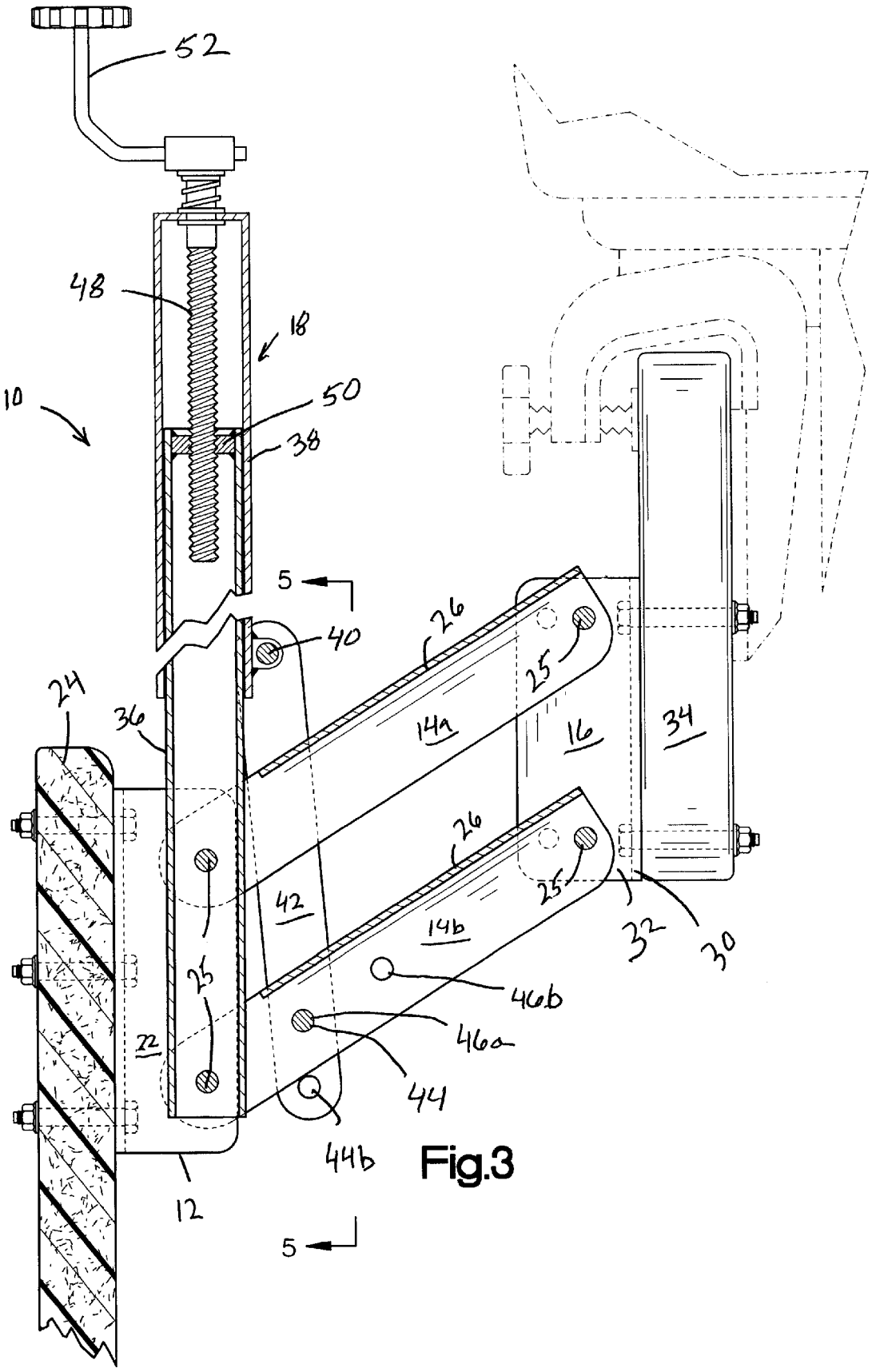
FIG. 3 is a cross-sectional view of the device shown in FIG. 1.

Now referring to the drawings showing the preferred embodiment, and particularly to FIG. 3, the mounting device of the present invention, generally designated 10, generally comprises a pair of transom mounting brackets 12, a pair of support members 14*a*,14*b*, a second pair of mounting brackets 16, and a jack member 18. The components of the device are preferably made from aluminum but may be of other suitable materials. The construction and operation of the device is discussed in detail below.

Figure 5:
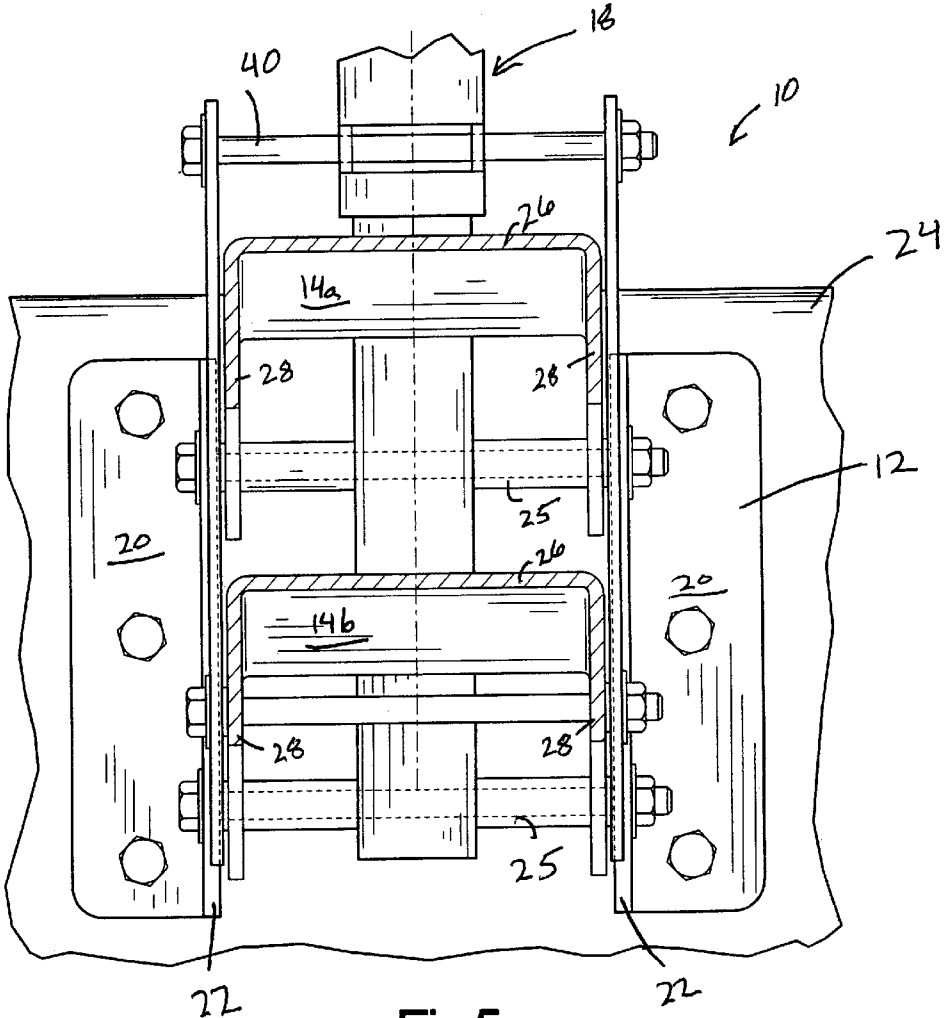
FIG. 5 is a cross-sectional view of the device shown in FIG. 3 along lines 5—5.

The device of the present invention utilizes a pair of generally L-shape transom mounting brackets 12. As best seen in FIG. 5, the transom brackets 12 include a transom mounting plate 20 and a support-member mounting plate 22 extending perpendicularly therefrom. Each plate 20,22 includes apertures therethrough for mounting the bracket 12 to it respective objects. As also shown in FIG. 3, the transom mounting plate 20 includes three apertures located therein for fastening the bracket 12 to a boat transom 24 via nuts and bolts. Apertures are located in the support member mounting plate 22 for pivotally connecting the support members 14*a*,14*b* to the transom mounting bracket 12.

Pins 25 pivotally retain support members 14*a*,14*b* at one end thereof between support member mounting plates 22 to provide pivotal movement for support members 14*a*,14*b* relative to the transom 24. Although any number of support members could be utilized, the preferred embodiment utilizes upper and lower support members 14*a*,14*b*. Each support member 14*a*,14*b* is similarly constructed and comprises a top surface 26 having downwardly extending sides 28. Located on either end of support members 14*a*,14*b* are apertures extending through both sides 28 for pivotally connection of the support members 14*a*,14*b* at both ends. As discussed above, support members 14*a*,14*b* are pivotally connected at one end to transom bracket 12 by pins 25. Support members 14*a*,14*b* are pivotally connected at the other end to another pair of generally L-shaped mounting brackets 16 by pins 25.

Mounting brackets 16 are generally similar to transom mounting brackets 12. Mounting brackets 16 comprise a poly-type board mounting plate 30 and a support-member mounting plate 32 extending perpendicularly therefrom. Each plate 30,32 includes apertures therethrough for mounting the bracket 16 to it respective objects. As best shown in FIG. 3, the board mounting plate 30 is connected to a poly-type motor support board 34 by a bolts. Support-member mounting plate 32 is likewise pivotally connected to support members 14*a*,14*b* by pins 25.

It is preferred that mounting brackets 16 include more that one set of apertures to which support members 14*a*,14*b* can be adjustably pivotally connected. By this, the upper and lower support members 14*a*,14*b* can be attached to the mounting bracket 16 in various positions, thereby permitting mounting bracket 16 and board 34 to be connected to the support members 14*a*,14*b* in a predisposed angular orientation offset from a vertical position. Preferably, the apertures located in mounting plate 32 permit the bracket 16 and mounting board 34 to be mounted to the device in a substantially vertical position or a ±10 degree position from vertical, although other angular positions could be utilized.

Figure 2:
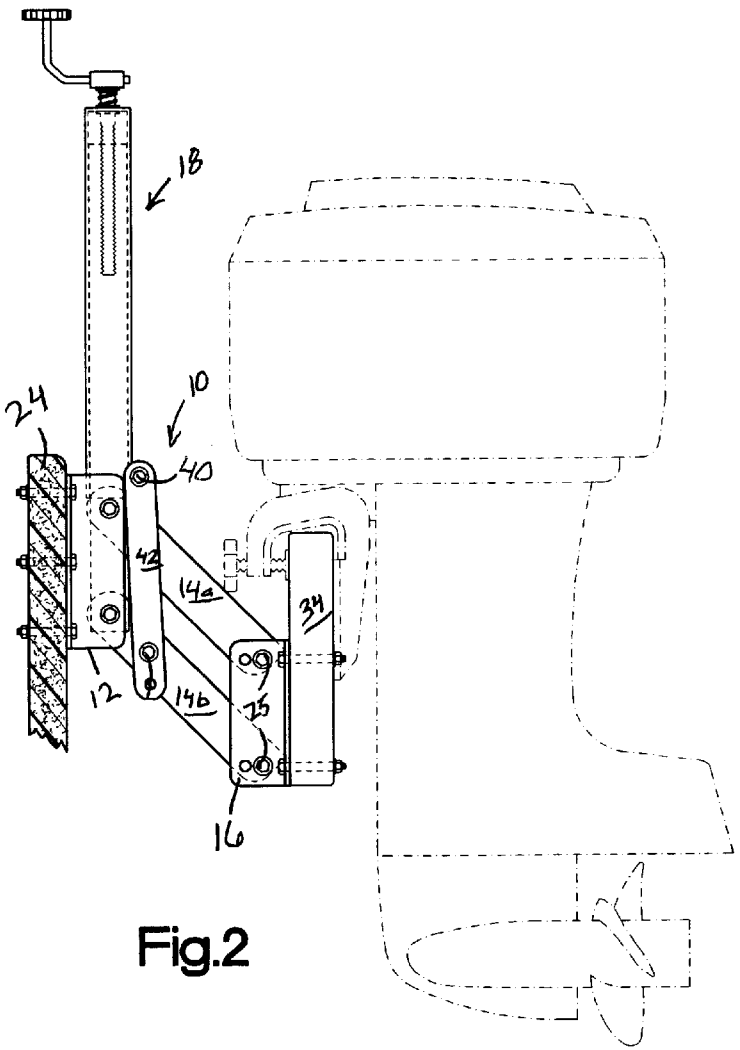
FIG. 2 is a side elevational view of the device of FIG. 1 showing the device at its lowest position.
Figure 1:
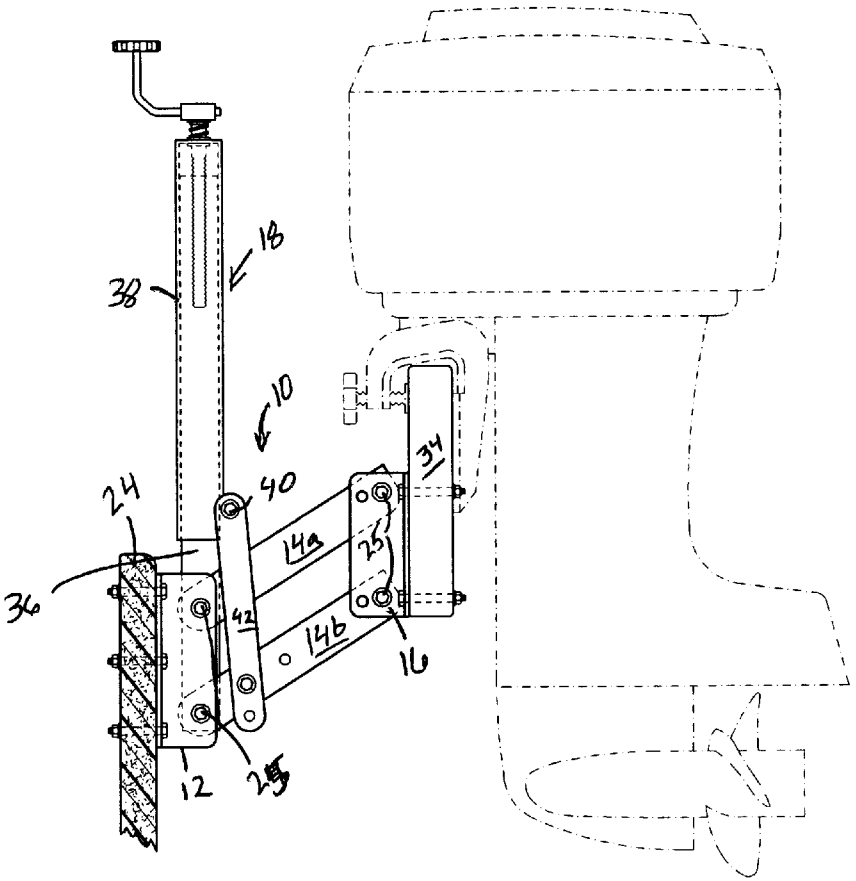
FIG. 1 is side elevational view of the device supporting an outboard motor, shown in phantom, at its highest position.

As is common in the art, the outboard motor (shown in phantom) is mounted by mounting clamp to the mounting board 34. Thus, as the support members 14*a*,14*b* are pivoted about the transom mounting bracket 12, the outboard motor is vertically positionally adjustable relative to transom 24 between a top position shown in FIG. 1 and a bottom position shown in FIG. 2. It is noted that the present invention not only maintains the supported device aft of the support and vertically adjusts the supported device, it also provides some adjustment of the supported device fore and aft relative to the transom during adjustment.

Pivotal movement of the support members 14*a*,14*b* is controlled by jack member 18. Jack member 18 comprises telescoping inner and outer tubes 36,38. The preferred embodiment utilizes square telescoping tubes although any configuration for either tube may be utilized. Inner tube 36 is connected to the transom mounting bracket 12 through pins 25 which pivotally connected support members 14*a*, 14*b* to transom bracket 12. Outer tube 38 is connected to a support member wherein telescopic movement of the outer tube 38 relative to the inner tube 36 pivots support members 14*a*,14*b* about their pivot points to vertically positionally adjust the motor.

As best shown in FIGS. 3 and 5, outer tube 38 has a pivot pin 40 welded to its exterior which pivotally carries a pair of linkages 42. Linkages 42 are pivotally connected at their other end to either support member 14*a* or 14*b*. As shown in the drawings, linkages 42 include apertures 44*a* and 44*b* that permit the effective length of the linkages 42 to be adjustable relative to the pivotally connected support member.

By permitting linkages 42 to be adjustable pivotally connected to the support member at a plurality of positions thereon, the height ratio the device provides can be adjusted to permit the support of the outboard motor at a highest position utilizing aperture 44*a* or a lowest position utilizing aperture 44*b*. Therefore, the device can be adjusted to suit numerous height requirements as needed.

Further, linkages 42 are also pivotally connected to the support member about a plurality of positions. Although the drawings indicate that the lower support member 14*b* is connected to the linkages 42, it is also anticipated that the linkages 42 could be mounted to the upper support member 14*a* or just one support member if only one support member is utilized. As shown in FIG. 3, lower support member 14*b* includes a plurality of apertures 46*a* and 46*b* located intermediate its pivot points. It is understood that the number of apertures and their position on the support member could be provided as desired.

As shown in FIG. 3, lower support apertures 46*a*,46*b* permit the linkages 42 to be pivotally connected to the lower support member 14*b* at two distinct positions. This adjustability permits the device to utilize distinct lifting ratios which allow the device to lift heavier objects or lighter objects easily. For example, if linkages 42 are pivotally connected to aperture 46*a*, the effective length of the lever would be from aperture 46*a* to the transom bracket pivot point. However, if linkages 42 were pivotally connected to aperture 46*b*, the effective length of the lever would be greater and thus the affect of the third class lever would be greater, thus making it easier to lift a heavier object. Therefore, separate ranges of motion and lifting ratios can be attained through the plurality of linkage apertures and the plurality of support member apertures providing multiple pivotal connections for the linkages 42 to connect to the support member.

Telescopic movement of the outer tube 38 relative to the inner tube 36 is accomplished through a fixed mechanical nut and threaded screw structure. Utilizing such a screw-nut structure permits the telescopic movement of the tubes 36,38 to be positionally adjustable over an infinite number of positions. Therefore, the outboard motor can be positionally adjusted over a continuous range of vertical positions.

Figure 4:
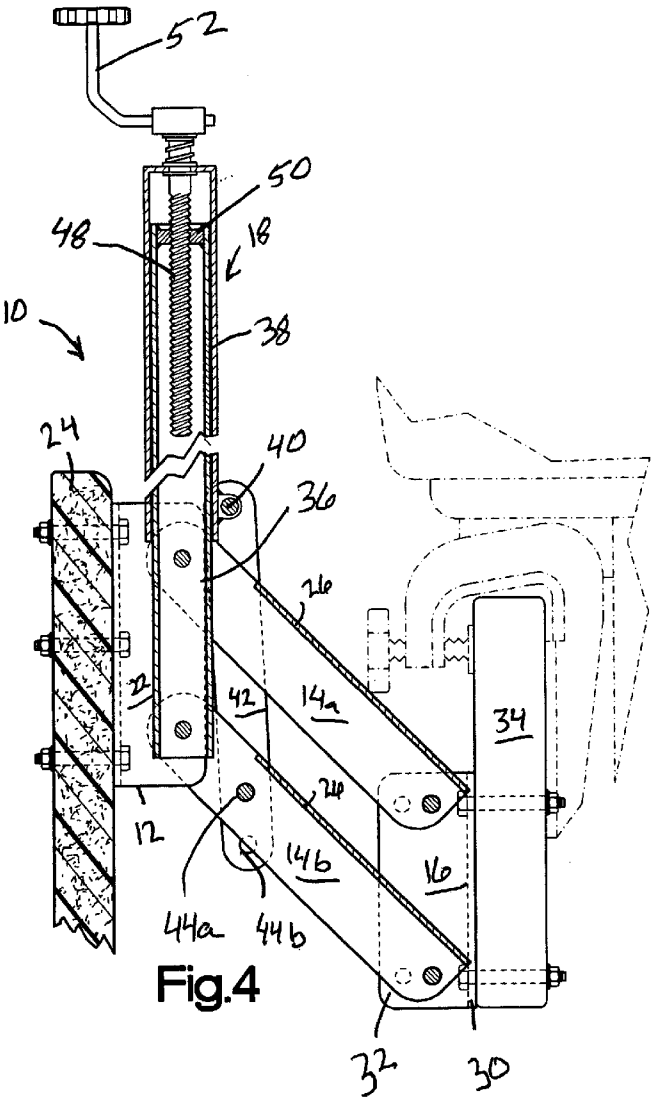
FIG. 4 is a cross-section view of the device shown in FIG. 2.

As best seen in FIGS. 3 and 4, threaded screw 48 extends through the interior of outer tube 38 and threadedly engages a fixed nut 50 mounted within the interior of inner tube 36.

A handle 52 is connected to an exterior shaft portion at the upper end of the threaded screw 48 to provide means for manually rotating the threaded screw 48. By rotating the threaded screw 48, the engagement between the screw 48 and the mounted nut provide pivotal movement to the support members 14*a*,14*b* and thus raise or lower the outboard motor. It is anticipated that numerous handle configurations could be utilized with the present invention including providing a removably mounted handle capable of mounting at different heights along the shaft portion of the screw 48. Also, the handle could include a hinge and universal coupler joint to permit the handle to be pivoted about the screw thread in numerous different positions to provide easier use and increased leverage.

In operation, handle 52 is rotated to threadedly insert or withdraw the screw 48 from the fixed nut 50 to create telescopic movement of the outer tube 38 relative to the inner tube 36. As shown in FIG. 3, the downward telescopic movement of the outer tube 38 relative to the inner tube 36 will cause linkages 42 to lower and permit support members 14*a*,14*b* to rotate in a clockwise fashion about the transom mounting bracket 12 so as to lower the outboard motor to a position shown in FIG. 4. By reversing the rotation of the handle, the above process is reversed and the outboard motor can be raised relative to the transom 24.

The invention has been described with reference to the preferred embodiment. Obviously, modifications and alternations will occur to others upon reading and understanding the specification. The claims as follows are intended to include all modifications and alterations insofar as they come within the scope of the claims or the equivalents thereof.

Having thus described the invention, we claim:

1. A mounting device for vertically positionally adjusting an outboard motor relative to a boat transom, said mounting device comprising:

a deformable frame assembly pivotally connected at one end to a boat transom and pivotally connect at the other end to an outboard motor, said outboard motor being vertically, positionally adjustable upon selective deformation of said frame assembly; and a jack member for controlling the selective deformation of said frame assembly, said jack member comprising telescoping inner and outer tubes wherein one of said inner or outer tubes is connected to said boat transom and the other said inner or outer tube is connected to said frame assembly, wherein telescopic movement of said outer tube relative to said inner tube deforms said frame assembly thereby vertically, positionally adjusting said outboard motor.

2. The mounting device of claim 1 wherein said jack member positionally adjusts said support device over a continuous range of positions.

3. The mounting device of claim 1 wherein telescopic movement of said outer tube relative to said inner tube is accomplished through a fixed nut and threaded screw mechanism.

4. The mounting device of claim 3 wherein said threaded screw is held within and extends through said outer tube and threadedly engages said fixed nut mounted within said inner tube to provide telescopic movement of said outer tube relative to said inner tube during threaded movement of said threaded screw through said fixed nut.

5. The mounting device of claim 4 wherein a handle is connected to one end of said threaded screw to provide means for manually implementing threaded movement of said threaded screw.

6. The mounting device of claim 1 wherein said outer or inner tube connected to said frame assembly is adjustably connected along the length of said support member to provide different height or lift ratios.

7. A mounting device for positionally adjusting a supported device relative to a support, said mounting device comprising:

a deformable frame assembly connected to a support and a supported device, said supported device being positionally adjustable upon selective deformation of said frame assembly;

a jack member for controlling the selective deformation of said frame assembly, said jack member comprising telescoping inner and outer tubes wherein said inner tube is connected to said support and said outer tube is connected to said frame assembly wherein telescopic movement of said outer tube relative to said inner tube positionally adjusts said supported device;

wherein telescopic movement of said outer tube relative to said inner tube is accomplished through a fixed nut and threaded screw mechanism so that said jack member positionally adjusts said support device over a continuous range of positions, wherein said threaded screw is held within and extends through said outer tube and threadedly engages said fixed nut mounted within said inner tube to provide telescopic movement of said outer tube relative to said inner tube during threaded movement of said threaded screw through said fixed nut; and a handle connected to one end of said threaded screw to provide means for manually implementing threaded movement of said threaded screw and wherein the height of said handle is adjustable relative to said threaded screw to provide ease of use.

8. The mounting device of claim 7 wherein said support is a boat transom.

9. The mounting device of claim 8 wherein said support device is an outboard motor.

10. A mounting device for vertically positionally adjusting an outboard motor relative to a boat transom, said mounting device comprising:

at least one bracket connected to a transom;

at least one support member pivotally connected to said bracket at one end and connected to an outboard motor at the other end wherein said motor is vertically positionally adjustable relative to said transom upon pivotal movement of said support member;

a jack member for controlling the pivotal movement of said support member, said jack member comprising telescoping inner and outer tubes wherein said inner tube is connected to said transom and said outer tube is connected to said support member wherein telescopic movement of said outer tube relative to said inner tube pivots said support member to vertically positionally adjust said motor.

11. The mounting device of claim 10 wherein said jack member positionally adjusts said motor over a continuous range of vertical positions.

12. The mounting device of claim 11, wherein telescopic movement of said outer tube relative to said inner tube is accomplished through a fixed mechanical nut and threaded screw structure.

13. The mounting device of claim 12 wherein said threaded screw extends through said outer tube and threadedly engages said fixed nut mounted within said inner tube to create telescopic movement of said outer tube relative to said inner tube during engagement of said threaded screw with said fixed nut.

14. The mounting device of claim 13 wherein a handle is connected to one end of said threaded screw to provide means for manually rotating said threaded screw.

15. The mounting device of claim 14 wherein the height of said handle is adjustable relative to said threaded screw.

16. A mounting device for vertically positionally adjusting an outboard motor relative to a boat transom, said mounting device comprising:

a first pair of brackets connected to a transom;

first and second support members pivotally connected at one end thereof to said first brackets;

a second pair of brackets pivotally connected to said first and second support members at the opposite end thereof, said second pair of brackets adapted to support a motor; and a jack member for controlling the pivotal movement of said support members, said jack member comprising telescoping inner and outer tubes wherein said inner tube is connected to said transom and said outer tube is connected to said first support member wherein telescopic movement of said outer tube relative to said inner tube pivots said first support member to vertically positionally adjust said motor.

17. The mounting device of claim 16 wherein said outer tube is connected to said first support member by a pair of linkage members pivotally connected at one end to said outer tube and pivotally connected at the opposite end to said first support member.

18. The mounting device of claim 17 wherein said pair of linkage members are pivotally connected to said first support member at a plurality of positions on said first support member.

19. The mounting device of claim 17 where said first support member is pivotally connected to said pair of linkage members at a plurality of positions on said pair of linkage members.

20. The mounting device of claim 17 wherein said first and second support members are pivotally connected to said second brackets at a plurality of positions on said second brackets.

21. A mounting device for vertically positionally adjusting an outboard motor relative to a boat transom, said mounting device comprising:

at least one bracket connected to a transom;

at least one support member pivotally connected to said bracket at one end and connected to an outboard motor at the other end wherein said motor is vertically positionally adjustable relative to said transom upon pivotal movement of said support member;

a jack member for controlling the pivotal movement of said support member, said jack member comprising telescoping inner and outer tubes wherein said inner tube is connected to said transom and said outer tube is connected to said support member wherein telescopic movement of said outer tube relative to said inner tube pivots said support member to vertically positionally adjust said motor; and wherein said outer tube is adjustably connected to said support member so adjustment thereof may provide different height or lift ratios.

* * * * *